US005738966A

United States Patent [19]

Okuno et al.

[11] Patent Number: 5,738,966

[45] Date of Patent: Apr. 14, 1998

[54] NON-MAGNETIC ONE-COMPONENT DEVELOPER AND IMAGE FORMING PROCESS

[75] Inventors: Hiroyoshi Okuno; Toyofumi Inoue; Tetsu Torigoe; Hiroe Okuyama; Koutarou Yoshihara; Masahiro Uchida, all of Minami-ashigara, Japan

[73] Assignee: Fuji Xerox Co., Ltd., Tokyo, Japan

[21] Appl. No.: 758,939

[22] Filed: Dec. 3, 1996

[30] Foreign Application Priority Data

Dec. 15, 1995 [JP] Japan ..... 7-326915

[51] Int. Cl.[6] ..... G03G 9/097

[52] U.S. Cl. ..... 430/110; 430/126

[58] Field of Search ..... 430/120, 110, 430/106

[56] References Cited

U.S. PATENT DOCUMENTS

| | | | |
|---|---|---|---|
| 4,833,059 | 5/1989 | Tomura et al. | 430/120 |
| 5,256,514 | 10/1993 | Law et al. | 430/110 |
| 5,256,515 | 10/1993 | Law et al. | 430/110 |

FOREIGN PATENT DOCUMENTS

| | | |
|---|---|---|
| B2-2-60183 | 12/1990 | Japan . |
| B2-7-62766 | 7/1995 | Japan . |

*Primary Examiner*—John Goodrow
*Attorney, Agent, or Firm*—Oliff & Berridge, PLC

[57] ABSTRACT

A negatively electrifiable, non-magnetic and single component developer comprising a binder resin, a carbon black and a charge control agent, wherein the carbon black has an average primary particle diameter of 20 to 50 nm and a pH of 2 to 5, and the charge control agent comprises a compound represented by the following formula:

wherein M represents a metal atom selected from the group consisting of zinc, iron, nickel and cobalt, and $R_1$ and $R_2$ each represents a hydrogen atom or an alkyl group having 1 to 6 carbon atoms. An image forming process using the developer is also disclosed. This one-component developer, which is suitable for use as a black toner in color image formation, can be stably charged and transported over long to give images free from fogging and having evenness of density and hardly poses problems such as dirts and color mixing over long.

12 Claims, 1 Drawing Sheet

FIGURE
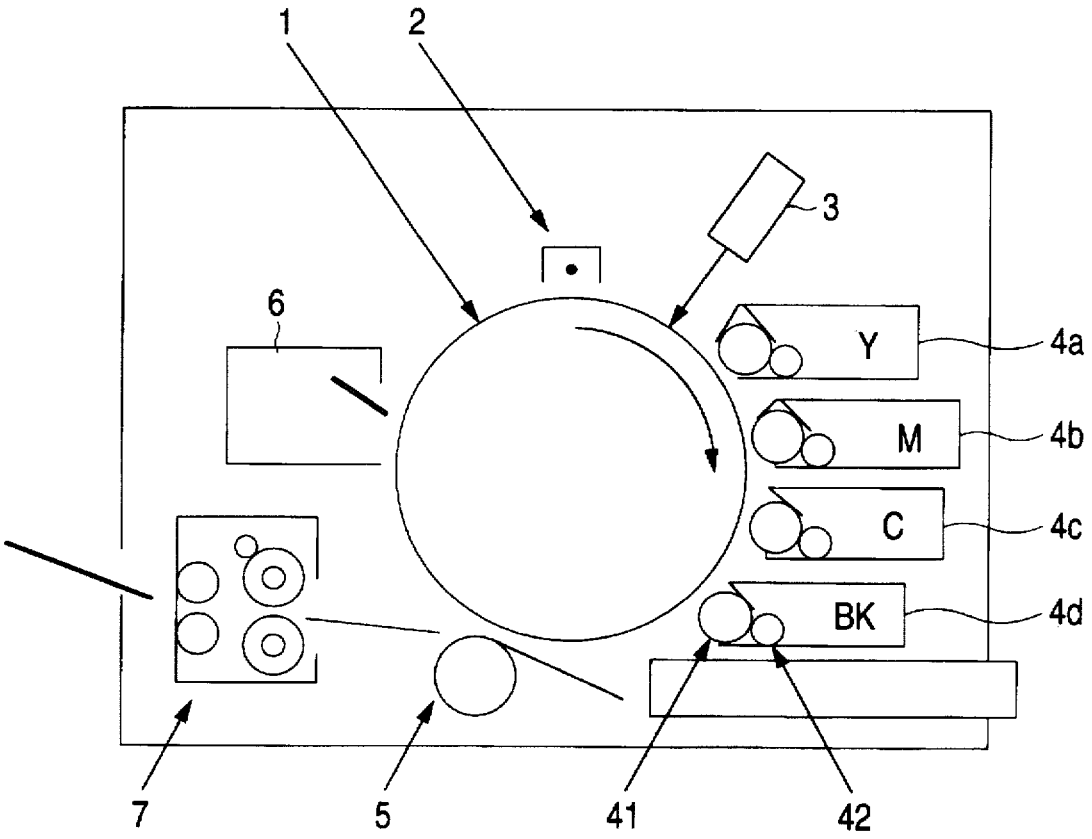

NON-MAGNETIC ONE-COMPONENT DEVELOPER AND IMAGE FORMING PROCESS

FIELD OF THE INVENTION

The present invention relates to a negatively electrifiable, non-magnetic and one-component developer and an image forming process using the same.

BACKGROUND OF THE INVENTION

Known as dry development methods in various electrostatic copying methods currently in practical use are development with a two-component developer comprising a toner and a carrier, e.g., iron powder, and development with a one-component developer containing no carrier. The two-component development method is disadvantageous in that the developer deteriorates as a result of adhesion of toner particles to the carrier surface, and that since the toner alone is consumed to lower the toner concentration in the developer, the development apparatus should have a larger size so as to maintain an appropriate toner/carrier proportion. In contrast, since the one-component development method is free from these disadvantages and has advantages of apparatus miniaturization, etc., it is becoming the main development method.

The one-component development method is classified into magnetic one-component development using a magnetic toner and non-magnetic one-component development using a non-magnetic toner. In the magnetic one-component development method, a developer carrier having a magnetic-field-generating means, e.g., a magnet, inside is used to carry a magnetic toner thereon for development. Although the magnetic one-component development method has recently been put to practical use in many small printers and the like, it is disadvantageous in that it is inapplicable to color printing because the magnetic toner used contains a black magnetic material, e.g., magnetite, within the toner particles.

On the other hand, the non-magnetic one-component development method has advantages that it is applicable to color printing because the developer contains no magnetic material in the toner, and that further reductions in weight and cost are possible because the development method does not employ a magnet in a developer carrier. Due to these advantages, the non-magnetic one-component development method has recently come to be put to practical use in small full-color printers, etc.

However, the non-magnetic one-component development method has the following disadvantage. The two-component development method, for example, employs a carrier as a stable charging/transporting member, while the magnetic one-component development method employs the magnetic force of a magnet roll as a stable means for transport and layer formation. In contrast, the non-magnetic one-component development method employs no such stable means for charging and transporting. Toners for use in the non-magnetic one-component development method are hence required to be more readily charged and have stable electrification characteristics because they should be carried on a developer carrier mainly by means of electrostatic force. In particular, non-magnetic one-component full-color developing apparatuses which employ toners of four colors, i.e., cyan, magenta, yellow, and black, tend to have troubles such as internal machine fouling and color mixing which are caused by fogging and dirts in non-image areas, because the black toner contains carbon black, having relatively low electrical resistance, as a colorant and is hence less charged and more unstably charged than the other toners of three colors. Consequently, a black toner should be designed so as to have a more stable electrification state.

A conventional method for stabilizing toner electrification is to incorporate a charge control agent into toner particles. Representative examples of negatively electrifiable charge control agents for black toners include chromium-containing azo dyes and salicylic acid compounds containing metals such as chromium, iron, and zinc. Of these charge control agents, the chromium-containing azo dyes are inferior in charge retention although effective in attaining relatively rapid electrification and a large electrification amount. Hence, the chromium-containing azo dyes, when used for non-magnetic one-component development, tend to pose the problem of fogging or dirts caused by a decrease in electrification amount as a result of long-term use. On the other hand, the metal-containing salicylic acid compounds are superior in charge retention to the chromium-containing azo dyes. In particular, chromium-containing salicylic acid compounds are the most commonly-employed because they can be charged rapidly in a large amount. However, the chromium-containing salicylic acid compounds, when used for non-magnetic one-component development, are disadvantageous in that since they have a wide charge distribution and poor charge exchangeability, toner deterioration during long-term use is apt to result in an increase in the proportion of toner particles of the opposite polarity to cause the problems of fogging and an image density decrease. Thus, there are further problems which should be solved in order to stabilize toner electrification and toner-layer formation in non-magnetic one-component development.

SUMMARY OF THE INVENTION

Under these circumstances, the present invention has been achieved in order to solve the problems described above.

An object of the present invention is to provide a non-magnetic one-component developer which can be stably charged and transported over long and stably give images free from fogging and having evenness of density. Another object of the present invention is to provide a non-magnetic one-component developer which hardly poses problems such as dirts and color mixing over long.

As a result of extensive investigations made by the present inventors in order to solve the problems described above, they have found that the above objects can be accomplished with a non-magnetic one-component developer which comprises at least a binder resin, a carbon black, and a charge control agent, wherein the charge control agent comprises a specific compound and the carbon black has characteristic values within respective specific ranges.

The non-magnetic one-component developer of the present invention comprises a binder resin, a carbon black, and a charge control agent. The carbon black has an average primary particle diameter of 20 to 50 nm and a pH of 2 to 5. The charge control agent comprises a compound represented by the general formula

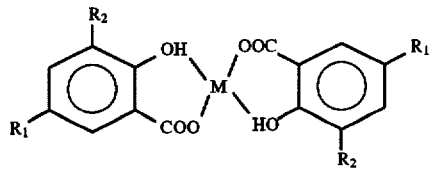

wherein M represents a metal atom selected from the group consisting of zinc, iron, nickel and cobalt, and $R_1$ and $R_2$ each represents a hydrogen atom or an alkyl group having 1 to 6 carbon atoms.

The image forming process of the present invention comprises a latent-image-forming step for forming a latent image on a latent-image holder, a development step for developing the latent image with a developer on a developer carrier, a transfer step for transferring the developed toner image to a receiving material, and a fixing step for fixing the toner image to the receiving material with heating. The developer for use in the image forming process is the negatively electrifiable, non-magnetic and one-component developer described above.

BRIEF DESCRIPTION OF THE DRAWING

The FIGURE is a diagrammatic view showing the constitution of a color image forming apparatus for use in the process for image formation of the present invention.

DETAILED DESCRIPTION OF THE INVENTION

The present invention is explained below in further detail.

The charge control agent contained in the negatively electrifiable, non-magnetic and one-component developer of the present invention comprises a metal-containing salicylic acid compound represented by the above-described general formula. In the general formula, M represents a metal selected from zinc, iron, nickel and cobalt. Of these, zinc is most preferred. $R_1$ and $R_2$ each represents a hydrogen atom or an alkyl group having 1 to 6 carbon atoms, but is preferably a hydrogen atom or an alkyl group having up to 4 carbon atoms in view of dispersibility into the binder resin and fixability. This charge control agent is effective in imparting a narrower charge distribution and better charge exchangeability than conventionally used chromium-containing salicylic acid compounds although inferior in electrification amount. Hence, even when the toner has deteriorated as a result of long-term use, the amount of toner particles of the opposite polarity is small and the toner hardly causes troubles such as fogging and low image densities. The developer of the present invention contains the charge control agent in an amount of 0.1 to 10% by weight, preferably 1 to 6% by weight, according to the necessary electrification amount.

Examples of the charge control agent for use in the present invention include zinc 3,5-di-t-butylsalicylate, iron 3,5-di-t-butylsalicylate, cobalt 3,5-di-t-butylsalicylate, zinc salicylate, and iron salicylate. Complexes of 3,5-di-t-butylsalicylic acid are especially preferred.

Although the carbon black for use in the present invention may be any of channel blacks produced by the channel process and furnace blacks produced by the furnace process, it should have a pH of from 2 to 5, preferably from 2 to 4, so as to impart sufficient negative electrifiability. Channel blacks tend to be acid carbon blacks having a high volatile content and a low pH, because the carbon blacks are necessarily exposed to a high-temperature oxidizing atmosphere for a period sufficient to oxidize the carbon black surface in the producing process, that is, the carbon blacks undergo a heat treatment. In contrast, furnace blacks undergo insufficient oxidation of the carbon black surface and have a relatively high pH, because they are produced through burning in a reactor having a limited capacity unlike channel blacks. Furnace blacks are hence used after being subjected to a post-treatment, e.g., a high-temperature oxidation treatment with air, oxygen or ozone or a wet oxidation treatment with a solution of nitric acid, hydrogen peroxide, etc., to increase the amount of oxygenic functional groups (e.g., carboxyl groups and phenol groups) present on the carbon black surface to thereby regulate the pH thereof. If a carbon black having a pH exceeding 5 is used, the developer cannot be charged in a sufficiently large amount and this tends to cause fogging and dirts. If a carbon black having a pH lower than 2 is used, the developer has a large environmental dependence of electrification to cause considerable fluctuations of image density.

The carbon black for use in the present invention has an average primary particle diameter of 20 to 50 nm. Since carbon blacks having an average primary particle diameter smaller than 20 nm have poor particle dispersibility in a binder resin, not only the developer has unevenness of electrification amount to cause unevenness of density, but also two toner layers tend to be formed on a sleeve to cause a decrease in image density and fogging. Carbon blacks larger than 50 nm are undesirable because a sufficient coloring power cannot be obtained. The average primary particle diameter of a carbon black herein means the value obtained by kneading a binder resin together with the carbon black to disperse the carbon black particles, taking a photograph thereof having a magnification of 30,000 diameters with a transmission electron microscope, and averaging the diameters of a hundred primary particles therein. The addition amount of the carbon black in the developer of the present invention may be in the range of 1 to 10% by weight, based on the weight of the developer. However, in view of coloring power and electrification characteristics, the amount thereof is preferably from 2 to 7% by weight.

Examples of the binder resin for use in the present invention include homopolymers and copolymers of: styrene and derivatives thereof such as chlorostyrene; monoolefins such as ethylene, propylene, butylene and isobutylene; vinyl esters such as vinyl acetate, vinyl propionate, vinyl benzoate and vinyl butyrate; esters of aliphatic α-methylene monocarboxylic acids, such as methyl acrylate, ethyl acrylate, butyl acrylate, octyl acrylate, dodecyl acrylate, phenyl acrylate, methyl methacrylate, ethyl methacrylate, butyl methacrylate and dodecyl methacrylate; vinyl ethers such as vinyl methyl ether, vinyl ethyl ether and vinyl butyl ether; and vinyl ketones such as vinyl methyl ketone, vinyl hexyl ketone and vinyl isopropyl ketone. Especially representative examples of the binder resin include polystyrene, styrene-alkyl acrylate copolymers, styrene-alkyl methacrylate copolymers, styrene-acrylonitrile copolymers, styrene-butadiene copolymers, styrene-maleic anhydride copolymers, polyethylene and polypropylene. Examples of the binder resin further include polyesters, polyurethanes, epoxy resins, silicone resins, polyamides, modified rosins and paraffin waxes.

A release agent may be incorporated in the one-component developer of the present invention for the purpose of improving gloss and non-offset properties. The release agent is preferably a paraffin having 8 or more carbon atoms, a polyolefin, etc. Examples thereof include paraffin waxes, paraffin latexes, microcrystalline wax, polypropylene, and polyethylene. These may be used alone or in combination. The addition amount the release agent is preferably from 0.3 to 10% by weight, based on the weight of the developer.

The one-component developer of the present invention comprises toner particles having a volume-average particle diameter of preferably from 4 to 10 μm, more preferably from 6 to 9 μm. If the volume-average particle diameter of the toner particles is smaller than 4 μm, a developer layer cannot be satisfactorily formed because of the significantly impaired flowability of the developer, and this tends to cause fogging and dirts. If the volume-average particle diameter thereof exceeds 10 μm, not only resolution is reduced, making it impossible to obtain high image quality, but also the amount of charges per unit weight of the developer decreases and, as a result, a developer layer cannot be stably formed and maintained and this tends to cause fogging and dirts.

Fine fluidizing agent particles are preferably added as an external additive to the one-component developer of the present invention for the purpose of imparting moderate flowability and electrification characteristics to the developer. Examples of the fine fluidizing agent particles include fine particles of inorganic substances such as hydrophobic silica, titania, and alumina, fine particles of organic substances such as fatty acids, derivatives of the acids, and metal salts of the acids, and fine particles of resins such as fluororesins, acrylic resins, and styrene resins. These may be used alone or in combination. Of these, hydrophobic silica or titania is especially preferred. The fine particles preferably have an average particle diameter of 7 to 40 nm. These fine particles may be used in an amount of 0.1 to 3 parts by weight, preferably 0.3 to 1.5 parts by weight, per 100 parts by weight of the toner. If the amount of the external additive is smaller than 0.1 part by weight, sufficient flowability cannot be imparted to the toner because the percentage of covering of the toner surface with fine particles is low. If the amount of the external additive is larger than 3 parts by weight, fine particles adhere to a photoreceptor and this tends to cause comets and filming.

The one-component developer of the present invention can be produced by any known method. In particular, the developer is preferably produced through kneading and pulverization. Specifically, the preferred method comprises melt-kneading a binder resin together with a carbon black, a charge control agent, and other optional ingredients by means of a kneading machine, e.g., a kneader or an extruder, cooling the mixture, subsequently pulverizing the same, classifying the resulting particles, and then mixing the particles with fine external-additive particles.

The image forming process of the present invention is then explained. The image forming process of the present invention comprises a latent-image-forming step for forming a latent image on a latent-image holder, a development step for developing the latent image with a developer on a developer carrier, a transfer step for transferring the developed toner image to a receiving material, and a fixing step for heat-fixing the toner image to the receiving material. The non-magnetic one-component developer of the present invention described above is used in the development step. It is especially preferably used as a black toner in the formation of full-color images using toners of four colors, i.e., yellow, magenta, cyan, and black. The FIGURE is a diagrammatic view showing the constitution of a full-color image forming apparatus for carrying out the image forming process of the present invention. The apparatus comprises a latent-image holder 1 and, disposed therearound, a corotron charging device 2, a laser optical device 3, four developing devices 4*a* to 4*d* respectively containing yellow, magenta, cyan, and black toners, a transfer roll 5, and a cleaner 6. The apparatus further has a fixing device 7. Each developing device has a developer carrier 41 disposed apart from the latent-image holder 1 at a given distance. A bias voltage is kept being applied between each developer carrier and the latent-image holder. In this image forming apparatus, an image is formed as follows. The latent-image holder 1 is charged with the corotron charging device 2 and then exposed to laser light with the laser optical device 3 to form an electrostatic latent image. Subsequently, an AC voltage and a DC voltage are applied to a developer carrier 41 and a developer feed roll 42 to develop the electrostatic latent image. The above cycle is conducted with respect to each of the toners of four colors to form toner images of four colors on the latent-image holder. Thereafter, the transfer roll 5 is brought into contact with the latent-image holder to simultaneously transfer the four color images. The transferred toner image is fixed by the fixing device. On the other hand, the toners remaining on the latent-image holder are removed by the cleaner 6. The gap between the latent-image holder and each developer carrier is preferably from 100 to 600 μm. The thickness of a toner layer on each developer carrier is preferably from 10 to 30 μm.

The latent-image-forming step in the present invention may be conducted by a known method. An electrostatic latent image is formed on a latent-image holder, e.g., a photosensitive layer or a dielectric layer, by electrophotography or electrostatic recording. For the photosensitive layer of the latent-image holder for use in the present invention, a known material such as an organic substance and amorphous silicon may be used. The cylindrical base thereof is obtained by a known process comprising, for example, extrusion-molding aluminum or an aluminum alloy into a cylinder and then processing the cylinder surface.

In the development step, a developer (or toner) fed by a developer feed roll to a rotating cylinder as a developer carrier (developing roll) is formed into a thin layer with an elastic blade or other means, and the developer layer is transported to the development nip. The developing roll and the latent-image holder on which an electrostatic latent image is held are in contact with each other at the development part or are apart from each other at a given distance. The electrostatic latent image is developed with the developer while applying a bias voltage between the developing roll and the latent-image holder. Examples of the developer carrier for use in the present invention include elastic sleeves made of, e.g., silicone rubber, drawn sleeves made of metals, e.g., aluminum and stainless steel, or of ceramics, and sleeves which undergo a surface treatment, e.g., oxidation, polishing, or blasting, or coating with a resin in order to control developer transportability and electrification characteristics. For forming a developer layer on the developing roll, the elastic blade is brought into contact with the sleeve surface. The material of the elastic blade is preferably a rubbery elastomer such as a silicone rubber or a urethane rubber. The elastomer may contain an organic or inorganic substance dispersed therein for the control of toner electrification amount.

For development with toners of the four colors, four developing devices disposed around a photoreceptor is used, for example, by a method in which a cycle comprising the steps of charging, exposure and development is conducted with respect to each of the four toners, or by a method in which a cycle comprising those steps is conducted once to perform charging, exposure and development for the four toners.

Toners of the four colors are superimposed by, for example, a method in which the a toner image formed on a photoreceptor to a transfer drum having receiving paper wound thereon is transferred successively for the individual colors to superimpose the colored toner images; a method in which toner images are successively formed on a photoreceptor and transferred to a transfer medium to superimpose the colored toner images on the transfer medium, and the superimposed images are then simultaneously transferred to receiving paper; or a method in which colored toner images are superimposed on a photoreceptor and then simultaneously transferred to receiving paper.

Known transfer means may be used such as contact type transfer means in which a transfer roll is pressed against a latent-image holder and non-contact type transfer means using a corotron.

The cleaning step is a step in which the untransferred toners remaining on the latent-image holder after the transfer step are removed with a cleaner. Known cleaning means may be used in the present invention, such as blade cleaning and roll cleaning. For the blade cleaning, an elastic rubber such as a silicone rubber or a urethane rubber is used.

The fixing step is a step in which the toner image transferred to a receiving material is fixed with a fixing device. A preferred fixing means is thermal fixing means using heated rolls. For improving gloss and OHP image quality, oil-coated rolls are used for fixing. For apparatus miniaturization, oilless fixing is conducted for which toners containing a release agent are used.

The present invention will be explained below in more detail by reference to Examples. Hereinafter, all parts are given by weight.

EXAMPLE 1

| | |
|---|---|
| Binder resin<br>Polyester resin (terephthalic acid/bisphenol A ethylene oxide adduct; weight-average molecular weight $M_w$: about 10,000; $T_g$: 67° C.) | 92 parts by weight |
| Carbon black<br>BPL (manufactured by Cabot Co., Ltd.; pH: 3.0; primary particle diameter: 25 nm) | 4 parts by weight |
| Charge control agent<br>Zinc 3,5-di-t-butylsalicylate | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 8.0 μm. Using a Henschel mixer, 100 parts by weight of the toner particles obtained were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28° C. and 85% RH and in a low-temperature and low-humidity atmosphere of 10° C. and 30% RH, with the environments switched every 1000 sheet printing. The results obtained are shown in Table 1. No color mixing was observed in the color images obtained.

EXAMPLE 2

| | |
|---|---|
| Binder resin<br>Polyester resin (terephthalic acid/bisphenol A ethylene oxide adduct; weight-average molecular weight $M_w$: about 10,000; $T_g$: 67° C.) | 92 parts by weight |
| Carbon black<br>Raven 5250 (manufactured by Columbian Carbon Co., Ltd.; pH: 2.2; primary particle diameter: 20 nm) | 4 parts by weight |
| Charge control agent<br>Zinc 3,5-di-t-butylsalicylate | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 8.2 μm. Using a Henschel mixer, 100 parts by weight of the toner particles obtained were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28° C. and 85% RH and in a low-temperature and low-humidity atmosphere of 10° C. and 30% RH, with the environments switched every 1000 sheet printing. The results obtained are shown in Table 1.

EXAMPLE 3

| | |
|---|---|
| Binder resin<br>Polyester resin (terephthalic acid/bisphenol A ethylene oxide adduct; weight-average molecular weight $M_w$: about 10,000; $T_g$: 67° C.) | 92 parts by weight |
| Carbon black<br>REGAL 400 (manufactured by Cabot Co., Ltd.; pH: 4.0; primary particle diameter: 26 nm) | 4 parts by weight |
| Charge control agent<br>Iron 3,5-di-t-butylsalicylate | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 8.3 μm. Using a Henschel mixer, 100 parts by weight of the toner particles obtained were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28° C. and 85% RH and in a low-temperature and low-humidity atmosphere of 10° C. and 30% RH, with the environments switched every 1008 sheet printing. The results obtained are shown in Table 1.

COMPARATIVE EXAMPLE 1

| | |
|---|---|
| Binder resin<br>Polyester resin (terephthalic acid/bisphenol A ethylene oxide adduct; weight-average molecular weight $M_w$: about 10,000; $T_g$: 67° C.) | 92 parts by weight |
| Carbon black<br>#40 (manufactured by Mitsubishi Chemical Co., Ltd.; pH: 8.0; primary particle diameter: 24 nm) | 4 parts by weight |
| Charge control agent<br>Zinc 3,5-di-t-butylsalicylate | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 7.8 μm. Using a Henschel mixer, 100 parts by weight of the toner particles obtained were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28°

C. and 85% RH and in a low-temperature and low-humidity atmosphere of 10° C. and 30% RH, with the environments switched every 1000 sheet printing. The results obtained are shown in Table 1.

COMPARATIVE EXAMPLE 2

| | |
|---|---|
| Binder resin<br>Polyester resin (terephthalic acid/bisphenol A ethylene oxide adduct; weight-average molecular weight $M_w$: about 10,000; $T_g$: 67° C.) | 92 parts by weight |
| Carbon black<br>BP 1300 (manufactured by Cabot Co., Ltd.; pH: 2.5; primary particle diameter: 15 nm) | 4 parts by weight |
| Charge control agent<br>Zinc 3,5-di-t-butylsalicylate | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 8.1 μm. Using a Henschel mixer, 100 parts by weight of the toner particles obtained were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28° C. and 85% RH and in a low-temperature and low-humidity atmosphere of 10° C. and 30% RH, with the environments switched every 1000 sheet printing. The results obtained are shown in Table 1.

COMPARATIVE EXAMPLE 3

| | |
|---|---|
| Binder resin<br>Polyester resin (terephthalic acid/bisphenol A ethylene oxide adduct; weight-average molecular weight $M_w$: about 10,000; $T_g$: 67° C.) | 92 parts by weight |
| Carbon black<br>#40 (manufactured by Mitsubishi Cheimcal Co. Ltd.; pH: 8.0; primary particle diameter: 24 nm) | 4 parts by weight |
| Charge control agent<br>Chromium salicylate compound | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 8.2 μm. Using a Henschel mixer, 100 parts by weight of the toner particles obtained-were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28° C. and 85% RH and in a low-temperature and low-humidity atmosphere of 10° C. and 30% RH, with the environments switched every 1000 sheet printing. The results obtained are shown in Table 1.

COMPARATIVE EXAMPLE 4

| | |
|---|---|
| Binder resin<br>Polyester resin (terephthalic acid/bisphenol A ethylene oxide adduct; weight-average molecular weight $M_w$: about 10,000; $T_g$: 67° C.) | 92 parts by weight |
| Carbon black<br>Raven 500 (manufactured by Columbian Carbon Co., Ltd.; pH: 7.0; primary particle diameter: 56 nm) | 4 parts by weight |
| Charge control agent<br>Zinc 3,5-di-t-butylsalicylate | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 8.0 μm. Using a Henschel mixer, 100 parts by weight of the toner particles obtained were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28° C. and 85% RH and in a low-temperature and low-humidity atmosphere of 10° C. and 30% RH, with the environments switched every 1000 sheet printing. The results obtained are shown in Table 1.

COMPARATIVE EXAMPLE 5

| | |
|---|---|
| Binder resin | |
| Polyester resin (terephthalic acid/bisphenol A ethylene: oxide adduct; weight-average molecular weight $M_w$: about 10,000; $T_g$: 67° C.) | 92 parts by weight |
| Carbon black | |
| Raven 1200 (manufactured by Columbian Carbon Co., Ltd.; pH: 5.5; primary particle diameter: 24 nm) | 4 parts by weight |
| Charge control agent | |
| Zinc 3,5-di-t-butylsalicylate | 4 parts by weight |

The above ingredients were mixed by means of a Henschel mixer and then melt-kneaded with an extruder at a temperature of 120° C., a screw speed of 300 rpm, and a feed rate of 150 kg/h. After cooling, the mixture was reduced into coarse particles, subsequently pulverized with a jet mill, and then classified with an air classifier to obtain toner particles having a volume-average particle diameter, $D_{50}$, of 8.0 μm. Using a Henschel mixer, 100 parts by weight of the toner particles obtained were mixed with 0.5 parts by weight of a silicone oil-treated silica having an average particle diameter of 12 nm. The resulting developer was placed into a black toner developing device of the image forming apparatus as shown in the FIGURE to perform a 5,000-sheet printing test in a high-temperature and high-humidity atmosphere of 28° C. and 85% RH and in a low-temperature and low-humidity atmosphere of 10° C. and 30% RH, with the environments switched every 1000 sheet printing. The results obtained are shown in Table 1.

(Image Forming Apparatus)

In the FIGURE is shown the image forming apparatus used for image quality evaluation. The apparatus comprised a latent-image holder 1 and four developing devices 4*a* to 4*d* respectively containing yellow, magenta, cyan, and black toners and disposed so that the developer carriers 4 were apart from the latent-image holder 1 at a given distance. The apparatus had been constructed so that the latent-image holder 1 was charged with a corotron charging device 2 and then exposed to laser light to form an electrostatic latent image, and that an AC voltage and a DC voltage were applied to each developer carrier 41 and each developer feed roller 42 to develop the electrostatic latent image. A cycle comprising the steps of charging, exposure and development was successively conducted four times for the four toners. For forming a toner layer on each developer carrier, a layer-forming blade made of a rubber was brought into contact with the developer carrier 41 at a given linear pressure. The peripheral speed of the latent-image holder 1 was 100 mm/s and that of each developer carrier 41 was 150 mm/s. After superimposed toner images of the four colors were formed on the latent-image holder 1, they were simultaneously transferred with a transfer roller 5. A blade type cleaner was used for cleaning.

TABLE 1

| | Image Quality | | | | | |
|---|---|---|---|---|---|---|
| | Initial image density | Image density after 5000-sheet printing | Unevenness of density | Fogging | Internal machine fouling | Comprehensive evaluation |
| Example 1 | 1.45 | 1.38 | o | o | o | o |
| Example 2 | 1.47 | 1.40 | o | o | o | o |
| Example 3 | 1.40 | 1.33 | o | o | o | o |
| Comparative Example 1 | 1.40 | 1.15 | x | x | x | x |
| Comparative Example 2 | 1.38 | 1.08 | Δ | Δ | o | Δ |
| Comparative Example 3 | 1.39 | 1.18 | x | x | o | x |
| Comparative Example 4 | 1.22 | 1.08 | x | x | x | x |
| Comparative Example 5 | 1.39 | 1.22 | Δ | Δ | Δ | Δ |

Remarks:
Unevenness of density
o: density fluctuation, not larger than 0.1
Δ: density fluctuation, 0.1–0.3
x: density fluctuation, not smaller than 0.3
Fogging
o: no fogging
Δ: slight fogging
x: considerable fogging
Internal machine fouling
o: no fouling
Δ: slight fouling
x: considerable fouling
Comprehensive evaluation
o: good
Δ: slightly bad
x: practically bad The non-magnetic one-component toner of the present invention, even if the toner deteriorates as a result of continuous use, has a narrow charge distribution and suffers little decrease in electrification amount. Therefore, the toner does not pose problems such as image density fluctuations, reduced developing properties, fogging, and internal machine fouling over long, and is capable of stably giving images of excellent quality.

While the invention has been described in detail and with reference to specific embodiments thereof, it will be apparent to one skilled in the art that various changes and modifications can be made therein without departing from the spirit and scope thereof.

What is claimed is:

1. A negatively electrifiable, non-magnetic and single component developer comprising a binder resin, a carbon black and a charge control agent, wherein the carbon black has an average primary particle diameter of 20 to 50 nm and a pH of 2 to 5, and the charge control agent comprises a compound represented by the following formula:

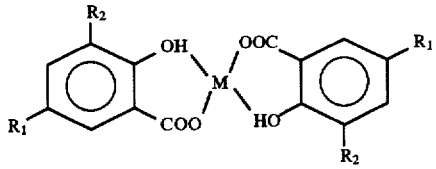

wherein M represents a metal atom selected from the group consisting of zinc, iron, nickel and cobalt, and $R_1$ and $R_2$ each represents a hydrogen atom or an alkyl group having 1 to 6 carbon atoms.

2. An image forming method comprising:

forming a latent image on a latent-image holding member;

developing the latent image using a developer on a developer carrier to form a toner image;

transferring the toner image to a transferring member; and heat-fixing the toner image on the transferring member, wherein the developer is a negatively electrifiable, non-magnetic and single component developer comprising a binder resin, a carbon black and a charge control agent, wherein the carbon black has an average primary particle diameter of 20 to 50 nm and a pH of 2 to 5, and the charge control agent comprises a compound represented by the following formula:

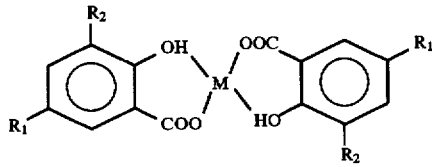

wherein M represents a metal atom selected from the group consisting of zinc, iron, nickel and cobalt, and $R_1$ and $R_2$ each represents a hydrogen atom or an alkyl group having 1 to 6 carbon atoms.

3. The image forming method according to claim 2, wherein the developing further comprises forming a thin layer of the developer on the developer carrier and developing an image with the developer carrier being in contact or out of contact with the latent-image holding member.

4. The developer according to claim 1, wherein the developer contains the carbon black in an amount of 1 to 10% by weight.

5. The developer according to claim 1, wherein the developer contains the charge control agent in an amount of 0.1 to 10% by weight.

6. The developer according to claim 1, wherein $R_1$ and $R_2$ in the formula each represents an alkyl group having 1 to 4 carbon atoms.

7. The developer according to claim 1, wherein the charge control agent is a complex of 3,5-di-t-butylsalicylic acid.

8. The developer according to claim 1, wherein M in the formula represents zinc.

9. The developer according to claim 1, wherein the carbon black has a pH of 2 to 4.

10. The developer according to claim 1, wherein the developer comprises toner particles having a volume-average particle diameter of 4 to 10 μm.

11. The developer according to claim 1, wherein the developer further contains an external additive.

12. The developer according to claim 11, wherein the external additive have an average particle diameter of 7 to 40 nm.

* * * * *